United States Patent [19]

Lorenzo

[11] Patent Number: 4,744,397

[45] Date of Patent: May 17, 1988

[54] ROTARY VENEER CUTTING MACHINE FOR THE CONVERSION OF A BLOCK OF WOOD INTO VENEERS, WITH AN IMPROVED TYPE OF DEVICE FOR PREVENTING SAG OF THE BLOCK OF WOOD

[76] Inventor: Cremona Lorenzo, Via Ramazzotti, 9, 20052 Monza (Milano), Italy

[21] Appl. No.: 44,661

[22] Filed: May 1, 1987

[30] Foreign Application Priority Data

May 22, 1986 [IT] Italy ..... 20538 A/86

[51] Int. Cl.[4] ..... B27L 5/02

[52] U.S. Cl. ..... 144/213; 144/365

[58] Field of Search ..... 144/209 R, 213, 213 A, 144/365

[56] References Cited

U.S. PATENT DOCUMENTS 4,073,326 2/1978 Pank et al. ..... 144/213

4,380,259 4/1983 Brookhyser et al. ..... 144/213

4,462,442 7/1984 Pointer ..... 144/213

*Primary Examiner*—W. Donald Bray

*Attorney, Agent, or Firm*—Finnegan, Henderson, Farabow, Garrett & Dunner

[57] ABSTRACT

A rotary veneer cutting machine for conversion of a block of wood into veneers comprises a device for preventing the block of wood from sagging which consists of a first and second set of pressure rollers which act respectively on the upper half and lower half of the block of wood. The first set of rollers is mounted along a beam which is translatable in the plane that contains it, from which beam there extend articulated arms carrying the said second set of rollers. With the said beam and said articulated arms there are associated guide means and actuators which keep the said sets of rollers in contact with the block of wood as its diameter decreases.

2 Claims, 2 Drawing Sheets

Figure 1:
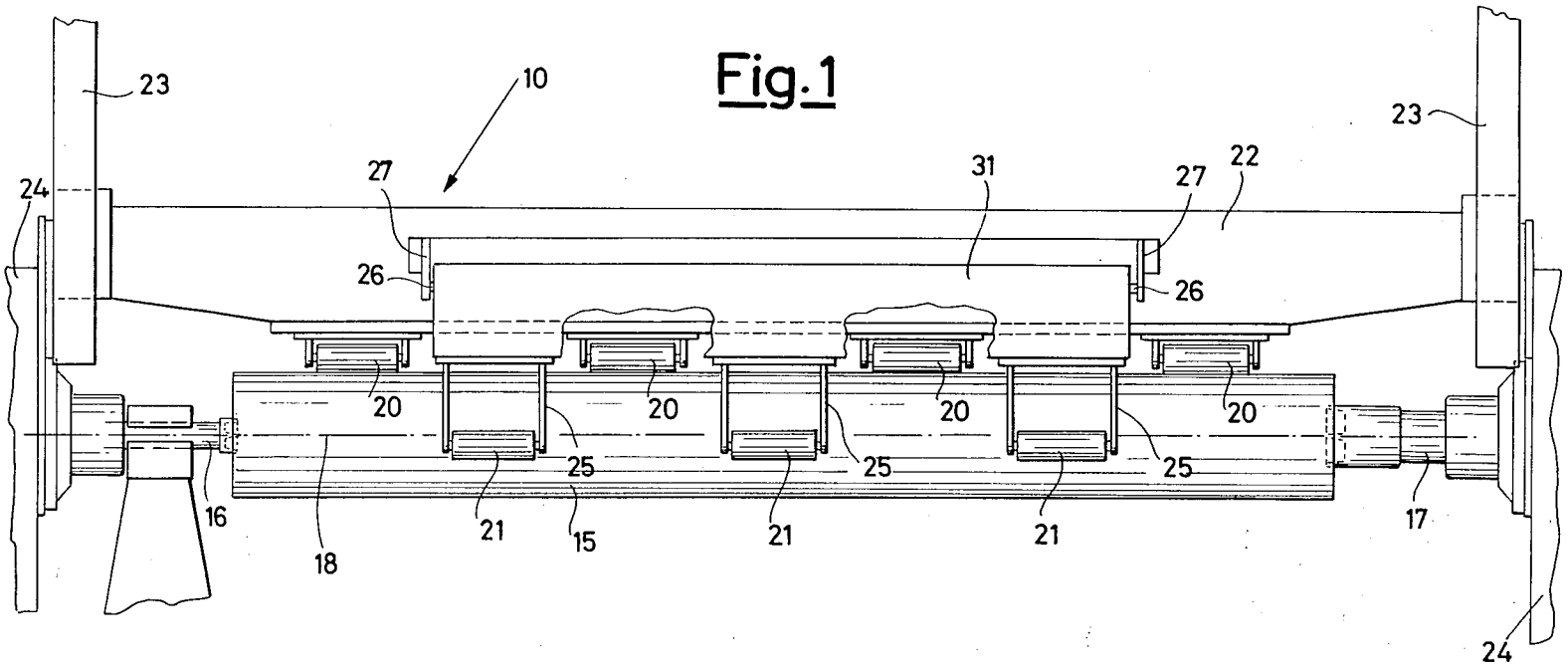

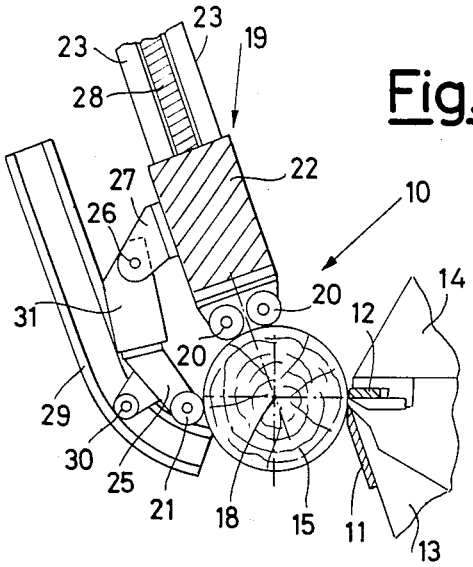
Fig. 2
Fig. 3
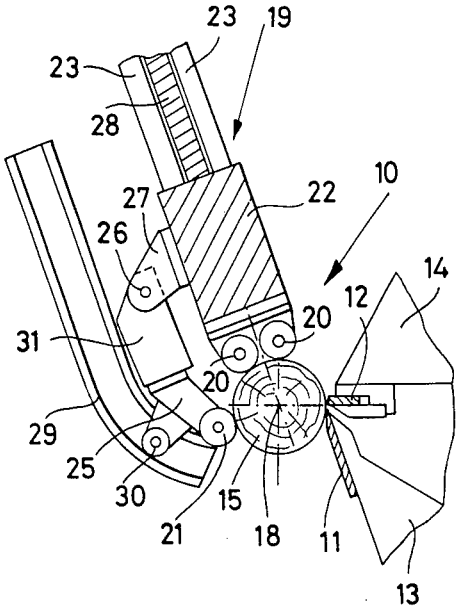
Fig. 4
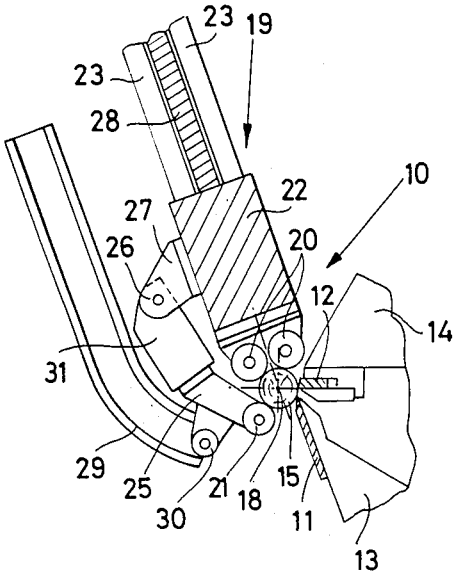

ROTARY VENEER CUTTING MACHINE FOR THE CONVERSION OF A BLOCK OF WOOD INTO VENEERS, WITH AN IMPROVED TYPE OF DEVICE FOR PREVENTING SAG OF THE BLOCK OF WOOD

As is known to persons with ordinary skill in the art, in rotary veneer cutting machines used for converting a block of wood into veneers the device employed for preventing the block of wood from sagging is of fundamental importance.

The purpose of such sag prevention device is to counter the result of the cutting forces so that the rotation axis of the block of wood always remains parallel to the cutting edge of the cutter, both at the start and during the final part of the cutting operation when, in the first instance, the diameter of the block of wood is large and, in the second instance, when it is small, and independently of the characteristics of hardness or softness of the wood being cut.

The said device is therefore employed to prevent the veneers from incorporating uneven thicknesses or puckerings due to loss of the aforesaid parallelism between the rotation axis of the block of wood and the cutting edge of the cutter.

In a veneer cutting machine such a device from preventing the block of wood from sagging must also be embodied so that the block of wood can be cut down to the diameter of its end-support mandrels, and also so as to permit the uncut portion of the block of wood to be ejected downwards.

The object of the present invention is to embody a sag prevention device the satisfies the aforementioned requirements.

To attain such object the present invention embodies a rotary veneer cutting machine of the type comprising a pair of opposed mandrels adapted to support in a rotatable manner a block of wood which is thrust againt a cutter blade by means of a sag prevention device, wherein the said device comprises a first and a second set of pressure rollers acting respectively on the upper and the lower half of the block of wood, the first set of rollers being mounted along a beam which is translatable in the plane that contains it, from which beam there extend articulated arms carrying the said second set of rollers, there being associated with the beam and articulated arms guide means and actuators that keep the sets of rollers in contact with the block of wood as the diameter of this decreases.

The structural and functional characteristics of the sag prevention device for rotary veneer machines according to the present invention, and its advantages over the known art, will become more apparent from an examination of the following description referred to the appended diagrammatic drawings showing one form of embodiment of the said device.

In the drawings:

FIG. 1 is a front elevation showing a rotary veneer cutting machine incorporating the sag prevention device in accordance with the invention;

FIGS. 2–4 diagrammatically show the sequence of operative phases of the device as cutting of the block of wood proceeds.

With reference to the drawings, the numeral 10 indicates overall a rotary veneer cutting machine for converting a block of wood into veneers, featuring a sag prevention device embodied in accordance with the principle of the present invention.

The veneer cutting machine 10 will not here be illustrated in greater detail in that its general structure is of a type known to persons with ordinary skill in the art.

In the interests of a clear understanding of the invention, the Figures show a cutter blade 11 and a pressure bar 12 carried by respective beams 13, 14.

The numeral 15 indicates a block of wood which is supported at opposite ends by coaxial mandrels 16, 17 which have a rotating movement about an axis 18 parallel to the cutting edge of the blade 11.

The numeral 19 indicates overall a sag prevention device embodied according to the invention which comprises a first set of freely rotating rollers 20 acting on the upper half of the block of wood 15 and a second set of freely rotating rollers 21 acting on the lower half of the said block 15.

The first set of rollers 20 is disposed along a beam 22 mounted slightly at its ends on rectilinear guides 23 carried by the machine frame 24.

The second set of rollers 21 is on the contrary carried by a beam 31 from which extends a plurality of shaped arms 25, the beam 31 is articulated at 26 to supports 27 solid with the beam 22.

The translation of the beam 22 along the guides 23 so as to keep the rollers 20 in permanent contact with the surface of the block of wood being cut can be controlled by any suitable known type of mechanism, such as for example a nut screw and leading screw mechanism 28, while the roller 21 are likewise kept in contact with the lower surface of the block by means of lateral cams 29 engaging respective cam sensors 1 or cam followers, 30 solid with the arms 25.

The FIGS. 2–4 of the appended drawings clearly show that, as the diameter of the block of wood 15 being cut by the blade 11 decreases, the sets of rollers 20, 21 can always be kept in stable contact with the block of wood by virtue of the syncronized feed movement of the beam 22 along the guides 23 in combination with the movement of rotation of the arms 25 about the articulation points 26.

Furthermore, it is evident how, at all times during its cutting, both when its diameter is maximal and when it is close to that of the mandrels, i.e. minimal, the block of wood 15 is positively supported at points that ensure that it will undergo no sag whatsoever, thus assuring the requisite parallelism between the rotation axis of the block of wood and the cutting edge of the blade, so as to obtain faultless veneers, i.e. without uneveness of thickness, puckering, wrinkles, etc.

I claim:

1. A rotary veneer cutting machine for converting a block of wood into veneers, said machine comprising a pair of opposed mandrels adapted to support in a rotatable manner a block of wood, a cutting blade, means for thrusting said block of wood against said cutting blade, and a sag prevention device comprising a first and a second set of pressure rollers adapted to act, respectively, on the upper and lower half of the block of wood, a beam translatable along the plane that contains it and having the first set of rollers mounted along said beam, articulated arms extending from said beam and carrying the said second set of rollers, and guide means and actuators associated with the said beam and articulated arms for keeping the said sets of rollers in contact with the block of wood as its diameter varies.

2. A rotary veneer cutting machine as described in claim 1, further including lateral cams and respective cam followers attached to said articulated arms for effecting the rotation of said arms.

* * * * *